US006373203B1

(12) United States Patent
Goseberg et al.

(10) Patent No.: US 6,373,203 B1
(45) Date of Patent: Apr. 16, 2002

(54) DIODE-SPLIT HIGH-VOLTAGE TRANSFORMER

(75) Inventors: Walter Goseberg, Neuenrade; Rolf Heidrich, Hannover; Hans Renner, Laatzen, all of (DE)

(73) Assignee: Thomson Licensing SA, Boulognie Cedexm (FR)

( * ) Notice: Subject to any disclaimer, the term of this patent is extended or adjusted under 35 U.S.C. 154(b) by 0 days.

(21) Appl. No.: 09/462,252

(22) PCT Filed: Jun. 25, 1998

(86) PCT No.: PCT/EP98/03882

§ 371 Date: Jan. 5, 2000

§ 102(e) Date: Jan. 5, 2000

(87) PCT Pub. No.: WO99/03118

PCT Pub. Date: Jan. 21, 1999

(30) Foreign Application Priority Data

Jul. 7, 1997 (DE) ..... 197 28 875
Nov. 22, 1997 (DE) ..... 197 51 864

(51) Int. Cl.[7] ..... H01J 29/70
(52) U.S. Cl. ..... 315/411; 336/170
(58) Field of Search ..... 315/411, 368.19, 315/368.25, 368.28; 336/170, 221, 222; 348/372; 323/355, 358, 359, 360

(56) References Cited

U.S. PATENT DOCUMENTS

| | | | | |
|---|---|---|---|---|
| 4,247,889 A | * | 1/1981 | Riechmann | 315/411 |
| 4,406,978 A | * | 9/1983 | Goseberg et al. | 315/411 |
| 4,429,358 A | * | 1/1984 | Miyagi | 363/68 |
| 4,654,775 A | | 3/1987 | Nero | 363/68 |
| 5,629,589 A | | 5/1997 | Goseberg et al. | 315/411 |
| 5,751,205 A | * | 5/1998 | Goseberg | 336/170 |
| 5,844,793 A | * | 12/1998 | Goseberg | 315/411 |

FOREIGN PATENT DOCUMENTS

| | | | |
|---|---|---|---|
| DE | 3822284 | 1/1990 | H01F/27/28 |
| EP | 0466642 | 1/1992 | H01F/27/36 |
| EP | 0529418 | 3/1993 | H04N/3/195 |
| FR | 1284438 | 1/1962 | |
| JP | 57-166313 | 4/1981 | H01F/19/04 |
| JP | 3-250703 | 11/1991 | H01F/5/02 |

OTHER PUBLICATIONS

Patent Abstracts of Japan, vol. 016, No. 045, Feb. 5, 1992 and JP 03–250703.

* cited by examiner

*Primary Examiner*—Don Wong
*Assistant Examiner*—Thuy Vinh Tran
(74) *Attorney, Agent, or Firm*—Joseph S. Tripoli; Harvey D. Fried; Joseph J. Kolodka

(57) ABSTRACT

The invention relates to a compact and cost-effective diode-split high-voltage transformer for high voltages of, in particular, above 20 kV, in which the high-voltage winding lies in chambers of a coil former underneath the primary winding and which contains elements by which the electric field between the coil former and the core is reduced in order to avoid corona effects. These elements include, for example, a conductive coating of the surface of the inner cavity of the coil former, which coating preferably comprises colloidal graphite. The conductive coating may also be realized by a metallized plastic film which is wound between the core and the coil former. Alternatively, the cavity between the core and the coil former may be filled with a material whose relative permittivity $\in_r$ is distinctly greater than that of air. The use of a larger number of diodes is also possible for reducing the electric field. The high-voltage winding is essentially covered completely by the primary winding, with the result that the interference radiation produced in the high-voltage winding is virtually completely screened. Applications arise in particular for television sets and computer monitors.

10 Claims, 3 Drawing Sheets

DIODE-SPLIT HIGH-VOLTAGE TRANSFORMER

BACKGROUND OF THE INVENTION

1. Field of the Invention

The present invention relates to a diode-split high-voltage transformer having a core, a primary winding and a high-voltage winding, which is arranged in chambers of a coil former.

2. Description of the Related Art

A diode-split high-voltage transformer of this type is disclosed in EP 0 529 418 B1, for example. This transformer contains a first coil former, which accommodates the primary winding and further auxiliary windings, and a second coil former, in which is arranged the high-voltage winding in the form of a chamber winding. The two coil formers are usually produced and wound separately. During final assembly, the coil former with the high-voltage winding, which has a correspondingly larger inner diameter, is pushed over the coil former with the primary winding. The coil formers are subsequently surrounded with a plastic housing and additionally potted with a synthetic resin composition for the purpose of suppressing corona effects and high-voltage flashovers. Embodiments of this type are used in television sets, for example, and supply high voltages in continuous operation of 24 kV up to above 30 kV.

DE 38 22 284 A1 discloses a high-voltage transformer having small dimensions for about 7 kV for copiers and the like. This transformer likewise has two coil formers, the coil former with the primary winding being pushed over the coil former with the high-voltage winding and latching into place therein. It is not designed as a diode-split high-voltage transformer and it cannot achieve high voltages of above 20 kV as required for television sets. It contains no rectifier diodes—these are arranged separately in the associated circuit. The particular intention, by using a chamber-type coil former, was to solve the high-voltage problems which arise here due to the small distance between the high-voltage winding and the core. Despite the considerably lower voltage of 7 kV, however, this design has not demonstrated satisfactory high-voltage strength in sustained operation, even with complete potting, and has therefore not been put into production.

SUMMARY OF THE INVENTION

The object of the present invention is to specify a diode-split high-voltage transformer of the type mentioned in the introduction which is constructed very compactly and cost-effectively and, in particular, has good high-voltage strength in continuous operation at voltages of above 20 kV.

This object is achieved by means of the invention specified herein. Advantageous developments of the invention are specified in the foregoing description.

In the case of the diode-split high-voltage transformer of the invention, the primary winding lies above the high-voltage winding and the high-voltage transformer contains means by which the electric field between the coil former and the core is reduced in order to avoid corona effects. For example, the surface of the inner cavity of the coil former is provided with a conductive coating, which, during operation, is at earth as a result of contact with the core, or at the same potential as the core. As a result, the electric field can be screened in the inherently unavoidable air gap between core and coil former, thereby effectively suppressing corona effects and voltage flashovers. Corona effects are produced in particular by ozone produced in the air by a high electric field. The conductive coating concentrates the electric field in the material between the high voltage winding and the conductive coating of the coil former, which ensures long-term high-voltage strength with an appropriate material and dimensioning.

The conductive coating used must be a high-impedance layer, for example colloidal graphite, which can be applied in a simple manner by means of a nozzle which sprays in the radial direction. A low-impedance, for example metallic, layer would constitute a short-circuited turn and lead to losses.

As an alternative, instead of the conductive coating, the remaining cavity between core and coil former may be filled with a material, so that corona effects are also avoided by this means. The material preferably has the highest possible relative permittivity $\in_r$, for example 2–3 or 4, and may be, for example, a viscous paste, possibly also the potting material of the high-voltage transformer itself. The material may also have a low conductivity. Air inclusions must not occur in the course of filling since, on account of the low relative permittivity $\in_r=1$, a high electric voltage builds up in the said inclusions and air can easily be ionized under the voltage conditions prevailing here.

Since the primary winding bears together with an insulating layer directly on the high-voltage winding, the entire arrangement becomes very compact. The chambers of the coil former also provide, with a multiple sheet winding, a sufficiently smooth surface onto which the primary winding can be wound uniformly and tightly with a wire thickness of, for example, 0.3 to 0.8 mm.

The wall thickness under the chambers of the high-voltage winding in the direction of the core are advantageously chosen such that they increase as the high voltage rises at the bottom of the chamber.

The high-voltage diodes may be arranged laterally with respect to the high-voltage chambers on the coil former, or alternatively they may be integrated between the high-voltage winding and the primary winding. In order to obtain a very inexpensive embodiment, the high-voltage winding is subdivided into four windings, a diode being respectively connected between the first and the second and the third and the fourth winding and a tap being routed out between the second and third winding for the focus voltage of a picture tube.

The compact structure of the coil former enables not only the housing of the high-voltage transformer but also its core to be considerably reduced in size. As a result of this, the potting compound can also be considerably reduced since there are no longer any high-voltage potentials on the outside of the high-voltage transformer. This not only leads to a considerable cost reduction but also affords space and weight advantages. Thus, it is possible to achieve a weight reduction of 25%, given the same electrical properties, with a diode-split high-voltage transformer (DST) having two diodes compared with a diode-split high-voltage transformer having three diodes. In addition, RLC circuits for attenuating the interference radiation are obviated.

In a further exemplary embodiment, the diode-split high-voltage transformer contains only one coil former, in which the high-voltage winding is arranged in chambers, the primary winding lying above the high-voltage winding and being wound onto an interposed sleeve or sheet winding. As an alternative, it is also possible to use a simple coil former for the primary winding, which coil former is pushed over the coil former with the high-voltage winding. If a sleeve is used, it may also be composed of two or more parts.

In an advantageous manner, the primary winding is somewhat wider than the high-voltage winding and covers the latter as far as possible completely. The higher-frequency interference radiation produced in the high-voltage winding is virtually completely screened by this means since the core (usually at earth potential) of the high-voltage transformer is situated on the inside of the high-voltage transformer and the covering, tightly wound primary winding is situated on the outside, and the outer chambers of the high-voltage winding carry either no or only a very small pulse voltage, depending on the design, since they are connected either to the reference potential or to the high-voltage connection directly or via a further chamber. These interference voltages are produced as a result of oscillations between the inductances and stray capacitances of the high-voltage transformer when the diodes change over from the conducting phase to the blocking phase. These facts have already been explained comprehensively in the literature, for example in EP 0 735 552 A1, and are not, therefore, discussed in any further detail here.

Since the primary winding is advantageously situated such that it fits above the high-voltage winding, the diodes cannot be arranged directly between the corresponding partial windings, for example on the webs of the chambers or above the chambers, rather they have to lie outside. The connections of the diodes to the high-voltage chambers are in this case routed via interposed high-voltage chambers. Very good coupling between the high-voltage winding and the primary winding is achieved, moreover, by the compact arrangement of the high-voltage transformer.

It is possible to arrange up to two diodes in a chamber in the lower part of the coil former lying in the direction of the circuit board. On the upper side of the coil former, diodes may be arranged on a continuation of the coil former. In particular, the lower diodes are arranged parallel to the lower part of the lower core limb and the upper diodes are arranged perpendicular to the upper part of the upper core limb, with the result that it is possible to use a core whose clear width is only slightly larger than the length of the primary and high-voltage windings since in this case the said core can be passed laterally out of the coil former through cutouts. The upper diodes are additionally arranged in such a way that after the winding of the high-voltage winding and the mounting and connection of the diodes, a single-part sleeve fitting exactly over the high-voltage winding can be pushed over the diode and the high-voltage winding.

Arrangements of diodes between high-voltage winding and primary winding are likewise possible, however. These may lie for example axially with respect to the coil former above the high-voltage chambers, parallel to the core, with the result that connections between partial windings of the high-voltage winding are simultaneously established hereby. The periphery of the primary winding consequently becomes slightly larger and may also acquire an oval shape.

The use of a larger number of diodes is also possible as the means for reducing the electric field for the purpose of avoiding corona effects. In further developments it has surprisingly been found that a high-voltage transformer of this type operates reliably even without a conductive coating. Thus, for example, a high voltage of 32 kV can be reliably generated in sustained operation with four diodes. It is still possible to obtain up to about 28 kV with three diodes, but this represents an uncertain upper limit. In a type with three diodes, therefore, a conductive coating is recommendable since the latter can be applied in one work operation with virtually no additional costs.

The explanation for the sufficient high-voltage strength for high-voltage transformers having three or more diodes without a conductive coating is that the outer chambers carry virtually no pulse voltages and in the inner chambers, by virtue of the larger number of diodes, the pulse voltages do not reach a voltage value which might lead to corona effects between the high-voltage chambers and the core.

The high-voltage transformer can be produced cost-effectively since it has only one complicated plastic component, the coil former with the high-voltage winding. Since the thin wire of the high-voltage winding, typically about 0.05 mm, is wound first in this case, this winding operation can be controlled very well. The sleeve or a sheet winding is subsequently applied and the thick wire of the primary winding and any further auxiliary windings can be wound on it without any problems. Since, in this arrangement, virtually no high voltage-carrying parts, in particular no parts having pulse voltages, lie on the outside of the coil former, and thus on the outer edge of the high-voltage transformer, the thickness of the synthetic resin composition between the coil former with the windings and the outer plastic housing of the high-voltage transformer can be reduced from 3 mm to less than 1 mm, as a result of which the plastic housing can be considerably reduced in size.

Since the primary winding now lies outside the high-voltage winding rather than within the latter, it is comparatively remote from the stray fields of the core, which are highly pronounced particularly around the air gap. Since the interference oscillations contain higher harmonics up to above 1 MHz, pronounced losses arose previously in the primary winding due to skin effects and eddy currents, which could be kept to a tolerable level only by means of thin wires of the primary winding, in particular by using expensive multiple-stranded wire. The novel arrangement makes it possible to use thick wire, for example copper having a thickness of 0.475 mm or more, without pronounced skin losses arising, as a result of which it is also possible to reduce the resistive losses in the primary winding. However, the primary winding situated on the outside must absorb the emitted interference radiation. In a preferred exemplary embodiment, the primary winding lies at a distance of about 7 mm from the core, whereas in earlier designs the distance is typically 1.5 mm.

The smaller periphery of the high-voltage winding means that the winding capacitances are considerably lower. This enables the number of turns to be increased, as a result of which the diameter of the ferrite core could be reduced. This not only affords a cost saving and space saving but also the losses in the ferrite core are reduced.

Further advantages are safe operation since, in the event of a short circuit in the high-voltage winding, which may lead to overheating, the transformer can no longer burst open because the high-voltage winding is surrounded very solidly by the primary winding which is wound tightly with thick wire. Furthermore, there is no need for an RLC circuit connected to the primary winding since the high-voltage is sufficiently stable. A design having four diodes enables, for example, a high-voltage transformer with 60 watts output voltage on the high-voltage side at 32 kV which has a cost reduction of more than 20% and is about the same size as a previous 30 or 40 watt transformer, with a weight of 200 grams. The weight can be reduced overall by 30% compared with earlier types having the same power output. Moreover, the height of the high-voltage transformer can be kept very low since the high voltage can be routed out at the bottom of the chambers and passed via a plastic sleeve in the housing from bottom to top to the connection. Insulation necessitates a tube of about 4 cm, virtually all of which lies in the housing of the high-voltage transformer. The present high-voltage transformer is thus excellently suited to recent television set or monitor chassis since the chassis structure is becoming ever more compact as a result of integrated circuits having higher and higher levels of integration. It need no longer be feared that interference radiation will interfere with the tuner circuit.

BRIEF DESCRIPTION OF THE DRAWINGS

The invention is explained below by way of example with reference to diagrammatic drawings, in which.

DETAILED DESCRIPTION OF THE PREFERRED EMBODIMENTS

Figure 1:
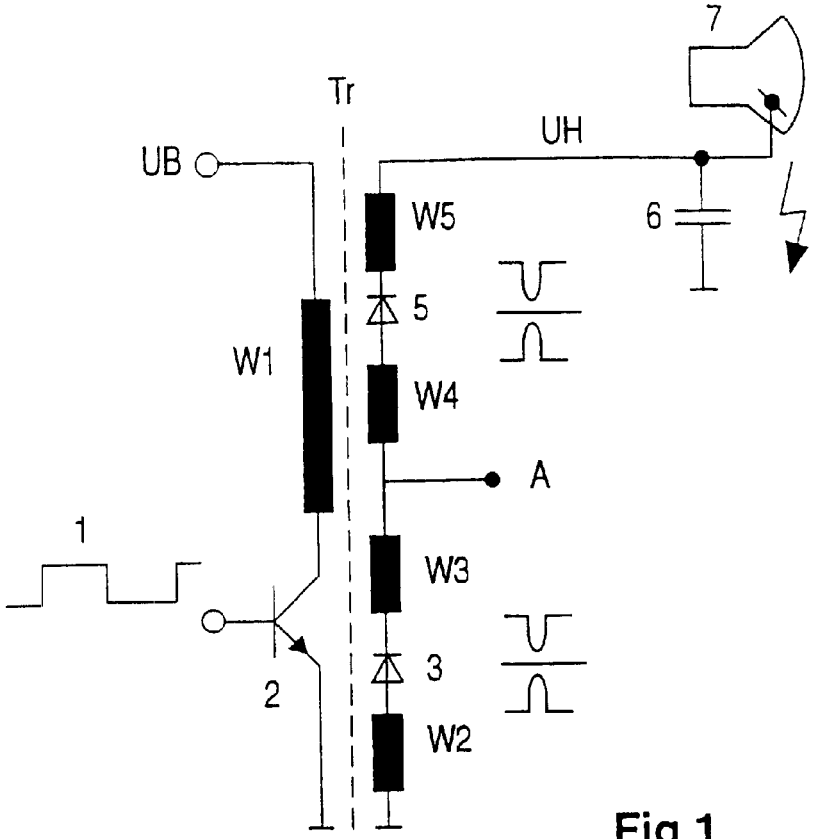
FIGS. 1 and 2 show a block diagram with a diode-split high-voltage transformer having two diodes and three diodes, respectively, for generating a high voltage for a picture tube.

Referring now to the drawings, FIG. 1 illustrates a diode-split high-voltage transformer Tr having a primary winding W1 and a high-voltage winding which is subdivided into partial windings W2–W5. One end of the primary winding W1 is connected to an operating voltage UB and the other end is connected to a switching transistor 2, which is switched on and off periodically by a drive signal 1. One end of the partial winding W2 is connected to a reference potential and the high voltage which is routed out at a connection UH for the operation of a picture tube 7 is present at one end of the winding W5. The high voltage UH is usually smoothed by cable capacitances of the connecting cable and capacitances in the picture tube 7, indicated here by the capacitance C.

The high-voltage winding is subdivided into four windings W2, W3, W4 and W5, a respective high-voltage diode 3 and 5, for the purpose of rectification, being interposed between the first and the second and the third and the fourth winding. A tap A for providing a high voltage for the focus electrode of the picture tube 7 is routed out between the second and third high-voltage winding W3, W4.

The switching transistor is turned off in the short time of the horizontal line flyback. This results in a high pulse loading for the high-voltage transformer Tr, and this loading must be taken into account in the design of the said transformer. Since the rectifying diodes are integrated between the windings of the high-voltage transformer in the arrangement of FIG. 1, it is evident that the outer ends of the high-voltage winding are free from AC voltage. Therefore, the pulsed loadings are essentially applied only to the diodes 3 and 5 and the winding ends adjacent to the diodes.

Figure 2:
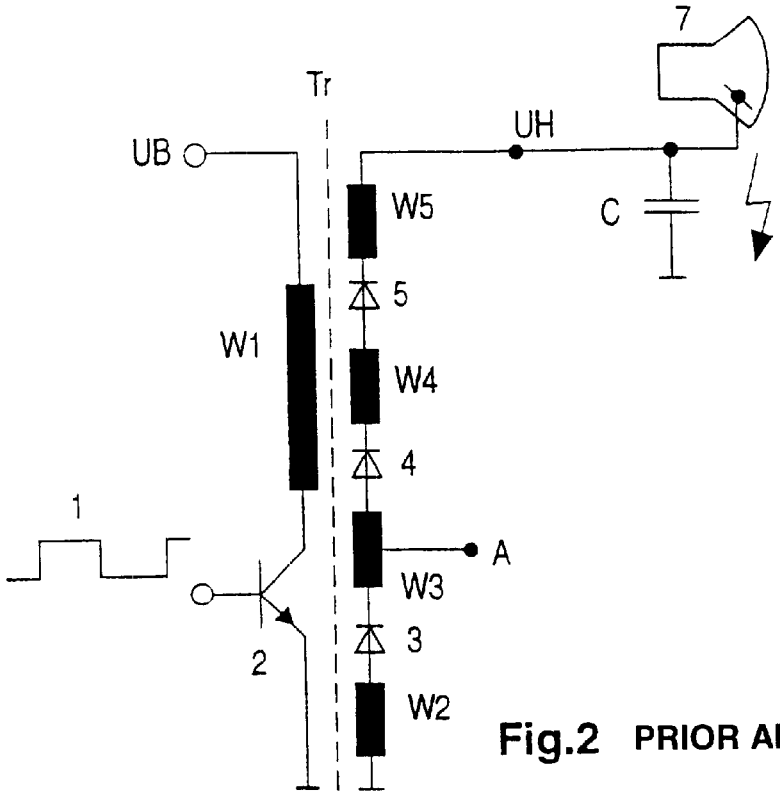
Fig.2 PRIOR ART

As a difference from FIG. 1, a diode-split transformer having three diodes is illustrated in the circuit of FIG. 2. A respective diode 3, 4, 5 is arranged between the partial windings W2–W5 and the tap A for the focus electrode is in this case routed out from the partial winding W3, as explained below with reference to FIG. 4. In both figures, and also in the ones after, identical concepts are provided with the same reference symbols.

Circuits of this type are usually used in television sets and computer monitors, to which reference is hereby made. The embodiments of a diode-split high-voltage transformer which are illustrated in FIGS. 1 and 2 are only by way of example; in particular the high-voltage winding can also be subdivided into more than four partial windings W2–W5.

Figure 3:
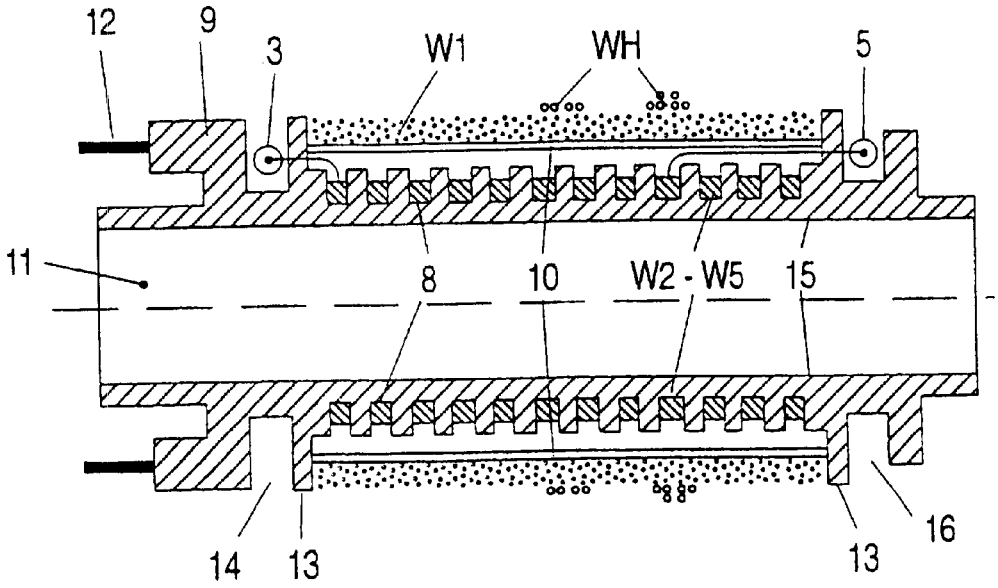
FIG. 3 shows a coil former with windings and two diodes for a high-voltage transformer.

FIG. 3 illustrates, in a sectional drawing, a coil former 9, which accommodates both the primary winding W1 and the high-voltage winding subdivided into the individual windings W2–W5, the windings W2–W5 lying underneath the primary winding W1. The coil former 9 contains an axial cavity 11, which accommodates the ferrite core (not illustrated). The coil former 9 contains a multiplicity of chambers 8, the bottom of which approximately has a thickness of 1 mm in the direction of the cavity and into which the individual windings W2–W5 of the high-voltage winding are wound. The coil former 9 advantageously contains twelve chambers 8, one of the windings W2–W5 being arranged in three of these chambers 8 in each case. The thickness of the bottom of the chambers 8 in the direction of the cavity 11 can be varied in accordance with the high-voltage loading in the form of DC and AC voltage, as disclosed by EP 0 028 383 B1, for example.

An insulating layer 10, which consists of a number of layers of a sheet winding in this exemplary embodiment, lies above the chambers 8. The primary winding W1 is wound in one or more tightly wound layers directly onto this insulating layer 10. In addition, auxiliary windings WH are applied to the primary winding W1, which auxiliary windings can advantageously be wound with the same wire thickness as that of the primary winding W1 in one work operation. Examples of practical wire thicknesses are 0.335 mm or more for the primary winding W1 and 0.05 mm of enamelled copper wire for the high-voltage winding. Likewise, the diode 5 can be placed also in the lower chamber 14 opposite to the diode 3.

At the chamber ends, the coil former 9 has lateral edges 13 for accommodating the sheet winding 10 and the primary winding W1. These raised parts are followed, towards the outside, by two further chambers 14, 16, which serve to accommodate the two high-voltage diodes 3, 5. The diodes 3, 5 are connected to the windings W2–W5 of the high-voltage winding.

As a result of this design, the chambers 8 with the high-voltage winding are completely covered by the sheet winding 10 and the primary winding W1, with the result that the low-impedance primary winding W1 implements effective screening of the high-frequency, intense interference radiation which is stepped up by the transformation ratio.

Owing to the short turns length (periphery of coil former in the chamber bottom) of the high-voltage windings W2–W5 and the smaller self-capacitance of the high-voltage windings that is caused as a result, it is possible to achieve a sufficiently stable high voltage with just two high-voltage diodes 3, 5, the stability of which high voltage is better than in the case of previously known diode-split high-voltage transformers having three diodes. It is also possible to use three or more diodes by means of which high-voltage stabilization would also become even better, or which would enable a higher output power.

In this exemplary embodiment, the inner cavity 11 of the coil former 9 is provided with a conductive coating on its entire surface 15, which conductive coating may be earthed, for example by contact with the ferrite core (not illustrated). The conductive coating used may advantageously be a colloidal graphite layer which can be applied in a spraying process and has a high-impedance conductivity. By this means, the inherently unavoidable air-filled interspace between the ferrite core and the coil former 9 is screened against the high voltage, with the result that corona formation is completely suppressed by this measure. The conductivity of the coating is chosen such that all currents, capacitive currents and eddy currents, in the said coating are avoided.

The layer with the colloidal graphite can preferably be applied by means of a liquid spray which contains colloidal graphite and adhesive in a solvent and which additionally slightly dissolves the plastic of the coil former 9 in order to increase the adhesion. This spray can be applied in a simple manner, for example using a nozzle which sprays in the radial direction and is led through the cavity 11 of the coil former 9.

On its under side, the coil former 9 contains electrical connections 12 by which the high-voltage transformer is fixed directly on a circuit board. It will additionally be surrounded by a plastic housing (not illustrated) which is open at the bottom, and be completely potted together with the latter by means of a synthetic resin composition.

As an alternative to a multiple sheet winding, a plastic sleeve is also possible as insulating layer between the primary winding and the high-voltage winding, which can be pushed down over the coil former 9 with the high-voltage winding W2–W5. The primary winding can then be wound together with the auxiliary windings directly onto the plastic sleeve. If both diodes 3, 5 are arranged in the chamber 14 lying at the base of the high-voltage transformer in the direction of the connections 12, then the entire coil former can be kept very compact even when a sleeve is used. The sleeve then lies in a positively locking manner over the chambers 8 of the high-voltage winding W2–W5 and covers the latter completely.

Figure 4:
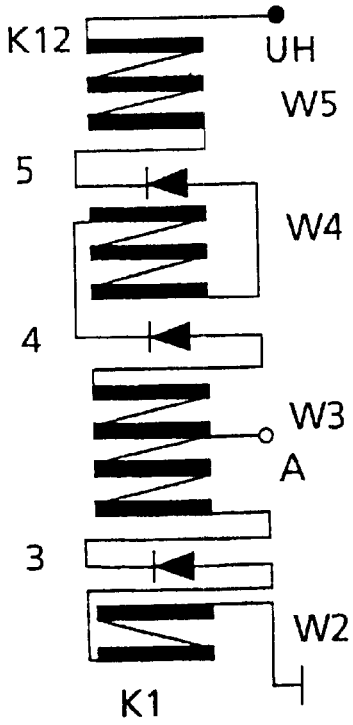
FIGS. 4 and 5 show the circuitry of high-voltage diodes and partial windings of high-voltage windings.

The high-voltage winding W2–W5 of FIG. 2 is explained in more detail with reference to FIG. 4. The high-voltage winding is designed as a chamber-type winding having twelve chambers K1–K12, the partial winding W2 being distributed between two chambers, the partial winding W3 between four chambers and the partial windings W4 and W5 in each case between three chambers. The partial windings W2–W5 respectively alternate in terms of their winding sense in order to obtain favourable tuning to higher harmonics, as a result of which the internal resistance of the high-voltage transformer is reduced. Therefore, in order to take account of the winding sense, the reference potential is connected to the second chamber winding and the high-voltage output UH is connected to the twelfth chamber K12. In this high-voltage transformer, the diodes 3–5 do not lie spatially between the partial windings W2–W5 but outside, for example diode 3 at the bottom and diodes 4 and 5 at the top, as is explained in more detail with reference to FIG. 5.

The chambers are advantageously wound as follows: firstly the chamber K1 and then the second chamber K2 are wound and afterwards the wire for the connection for the reference potential is routed out. The chambers K3–K6 are subsequently wound. Winding is then continued beginning with the chamber K12 up to the tenth chamber, which is connected to the diode 5. The ninth, eighth and seventh chambers can subsequently be wound.

The focus connection A is advantageously routed out at the winding of a chamber, in this case chamber K5 of the partial winding W3, which is symmetrical with respect to two diodes, with respect to the diodes 3 and 4 in this exemplary embodiment, so that the focus voltage is virtually free from AC voltage. The partial winding W3 and the other partial windings W2, W4, W5 are constructed in such a way that the voltage value desired for focus is approximately available at the focus connection F.

Figure 5:
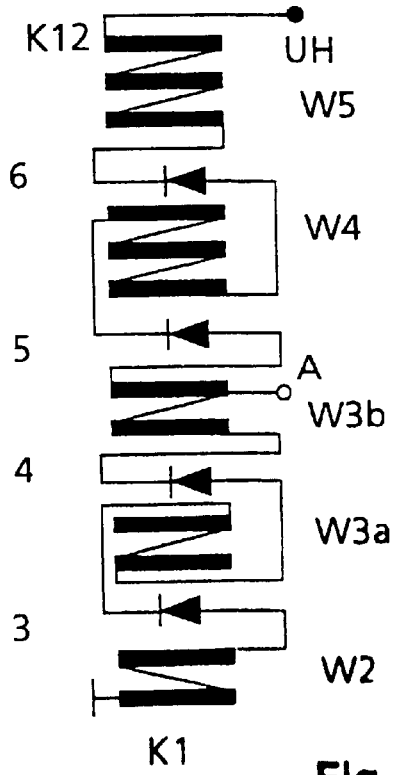

FIG. 5 illustrates a high-voltage winding having five partial windings W2, W3*a*, W3*b*, W4 and W5 and having four diodes 3–6. The partial windings W2–W5 likewise alternate in this case, the reference potential being connected to the bottommost chamber K1 and the high-voltage connection UH being connected to the topmost chamber K12. This exemplary embodiment enables a beam current of 2 mA at a high voltage of 32 kV, while the exemplary embodiment of FIG. 4 enables a maximum beam current of 1.5 mA at a high voltage of 28 kV. In terms of the spatial dimensions of the chambers, both types are identical; the essential difference is that the partial winding W3 of FIG. 4 is subdivided in FIG. 5 into two partial windings W3*a* and W3*b* between which the fourth diode 4 is connected. In principle, the chambers K1–K12 can be wound in the same way as the chambers of FIG. 4. In the exemplary embodiment of FIG. 5, the diodes 3 and 4 lie below the chamber K1 and the diodes 5 and 6 lie above the chamber K12 and the connection wires between the diodes and the chambers are in each case led back over the corresponding chambers.

Figure 6:
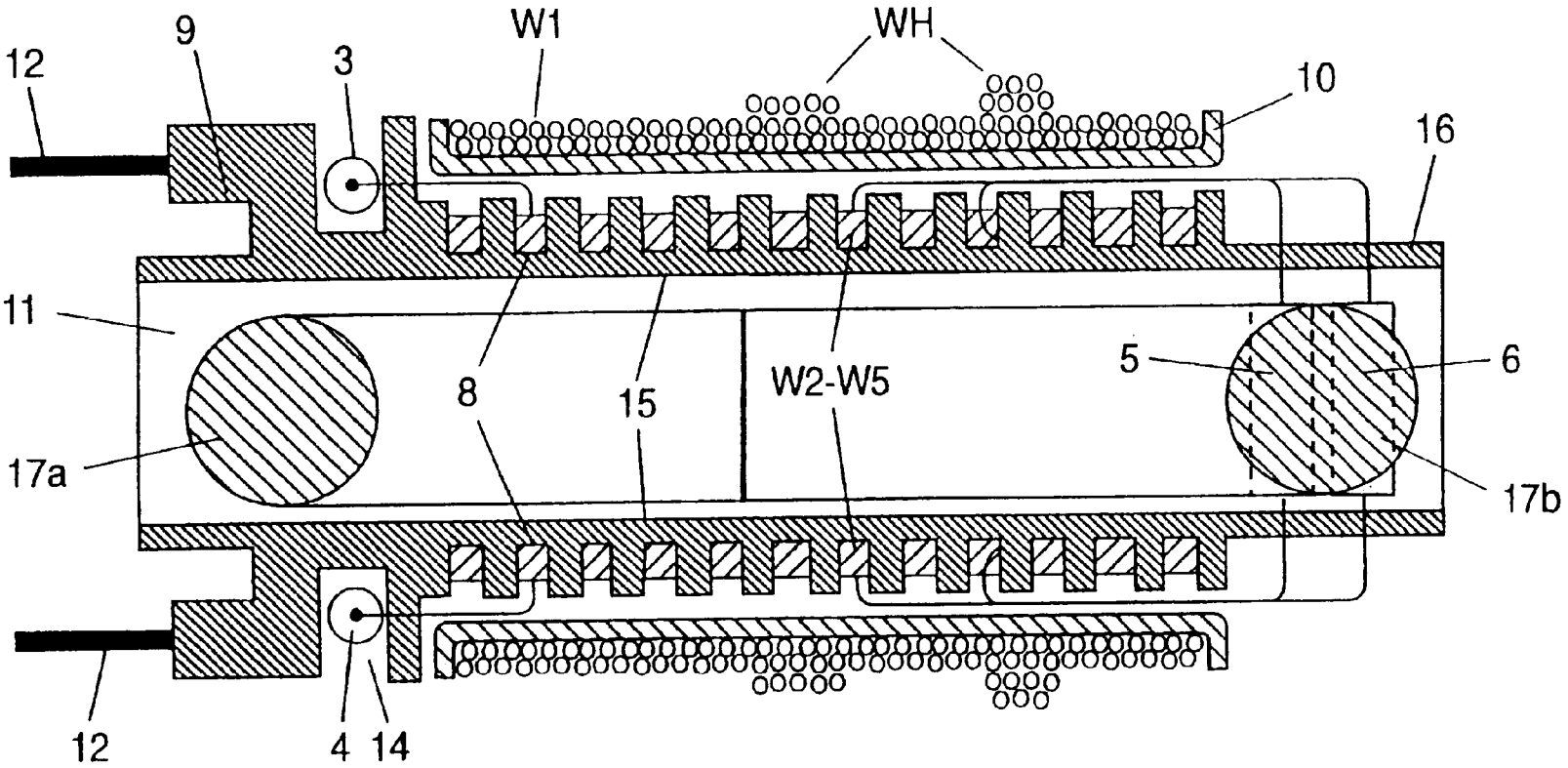
FIG. 6 shows a coil former with windings, four diodes and a core for a high-voltage transformer.

FIG. 6 is a sectional drawing illustrating a further exemplary embodiment, a coil former 9 and a ferrite core comprising two core halves 17*a* and 17*b*. The partial windings W2–W5 are arranged in twelve chambers 8 of the coil former 9, as already explained with reference to FIGS. 4 and 5. The thickness of the chamber bottoms towards the inner cavity 11 of the coil former 9 into which the two core halves 13*a* and 13*b* are introduced is about 1–2 mm, depending on the level of the pulse voltage in the individual chambers.

The chamber-type coil former 9 contains connection pins 12 by which the high-voltage transformer is fixed to a circuit board. Situated underneath the chambers 8 with the high-voltage winding, on the left in the figure, is a further chamber 14 in which two diodes 3 and 4 are arranged. Two further diodes 5, 6 are arranged above the chambers 8 on an extension 16 of the coil former 9. The diodes 3–6 and the high-voltage chambers 8 are wired up in accordance with the exemplary embodiment of FIG. 5.

In this exemplary embodiment, the primary winding W1 is wound onto a sleeve 10, instead of a sheet winding, which completely covers the high-voltage windings W2–W5. The sleeve 10 lies as tightly as possible, in a positively locking manner, over the chambers 8. The diodes 5 and 6 are arranged on the extension 16 in such a way that the sleeve 10 can be pushed over them without any obstruction. By this means, there is no need for a two-part, longitudinally split sleeve, or a sheet winding, for avoiding these diodes. Additional auxiliary windings WH with the same wire thickness are applied to the primary winding W1 in a further winding operation.

The chambers 8 with the windings W2–W5 are surrounded by the primary winding W1 towards the outer side and by the two core halves 17*a*, 17*b* towards the inner side, the said core halves being at earth potential. The outer chambers 8 are at a DC voltage potential, as already explained with reference to FIGS. 4 and 5. By virtue of this arrangement, the pulse-carrying inner chambers of the high-voltage winding are surrounded virtually completely by DC voltage-carrying elements or conductors having a low internal resistance, with the result that these chambers are very effectively screened. Even when one of the outer chambers is not connected directly to a DC voltage potential, such as, for example, on account of the alternating winding sense, as explained in FIG. 4, the screening still exceeds 90%.

During final assembly, the coil former 9 is additionally surrounded by a plastic housing (not illustrated) which, on the top side, has a box attachment which receives the extension 16 of the coil former 9. The diodes 5 and 6 are in this case perpendicular to the upper core part 13*b*, with the result that the core can be led away laterally directly over the windings W1–W5 and the primary winding W1. In the lower part of the coil former 9, the diodes 3, 4 are arranged parallel to the lower core part 13*a*, thereby enabling a cutout in the coil former 9 through which the lower core half 13*a* is led out. This compact arrangement makes it possible to reduce the weight of the core from 133 g to only 80 g, compared with an earlier type with the same power output. It was possible to reduce the core diameter even further by using a core material having higher permeability.

It is evident from this arrangement that, except for the connection wires of the diodes, there are no longer any high voltage-carrying parts on the outside of the coil former. It was therefore possible to reduce the synthetic resin layer between the coil former 9 and the outer housing from 3 mm to less than 1 mm, enabling a considerable weight and space saving.

Further embodiments having more than four diodes are likewise possible. In embodiments having at least four diodes, a conductive coating on the surface 15 of the inner cavity 11 of the coil former 9 is no longer required, unlike a type having two diodes in which this is absolutely necessary. Tests to date for types with four or more diodes show that even under elevated loading and in sustained operation, no corona effects or flashovers occur between the high-voltage windings arranged in the chambers 8 and the two core halves 17*a*, 17*b*. Since the conductive coating can be applied at no great effort and with no significant costs on the surface 15 of the inner cavity 11, it may be applied in addition, depending on the design, for example for a type having three diodes, since at 28 kV this design is approximately at the limit of the voltage loading capacity, and should be undertaken for long-term safety of the high-voltage transformer. For a three diode type with 29.5 kV the coating is absolutely necessary. For the four diode type the high voltage pulses are in the region of 2–3 kV or below in which no corona occurs. But at 32 kV or above for this type a coating is also suggested. Corona effects have to be avoided totally because even very small corona effects can damage the high-voltage transformer after a long time of operation.

What is claimed is:

1. A diode-split high-voltage transformer comprising a core, a primary winding and a high-voltage winding, which is arranged in chambers of a coil former, said coil former comprising an inner cavity for accommodating said core, and said primary winding and said high-voltage winding being arranged concentrically around said core, said primary winding lying above said high-voltage winding, and the surface of said inner cavity of the coil former being provided with a conductive coating for reducing the electric field between said coil former said the core in order to avoid corona effects.

2. The high-voltage transformer according to claim 1, characterized in that the conductive coating contains colloidal graphite.

3. The high-voltage transformer according to claim 1, characterized in that the conductive coating is realized by a metallized plastic film which is wound in an overlapping manner between the coil former and said core.

4. The high-voltage transformer according to claim 1, characterized in that in that an insulating layer is arranged between the primary winding and the high-voltage winding, said insulating layer consisting of either a multiple sheet winding, a simple coil former or a sleeve.

5. The high-voltage transformer according to claim 4, characterized in that the primary winding is arranged in one or more tightly wound layers on the insulating layer and essentially covers the high-voltage winding for the purpose of screening interference radiation.

6. The high-voltage transformer according to claim 5, characterized in that the high-voltage diodes, for the purpose of rectification, are arranged laterally with respect to the high-voltage chambers.

7. The high-voltage transformer according to claim 6, characterized in that one or two diodes are arranged to the left of the chambers, in the direction of a connection board, and one to three diodes to the right of the chambers of the high-voltage winding on the coil former.

8. The high-voltage transformer according to claim 7, characterized in that the diodes placed on the left are arranged in a chamber parallel to the lower core part and in that the diodes placed on the right are arranged perpendicular to the upper core part on a continuation of the coil former.

9. The high-voltage transformer according to claim 4, characterized in that said insulating layer consists of a sleeve with side walls.

10. A diode-split high-voltage transformer for voltages of above 20 kV up to 35 kV, comprising a core, a primary winding and a high-voltage winding which is arranged in chambers of a coil former, said coil former comprising an inner cavity for accommodating said core, and said primary winding and said high voltage winding being arranged concentrically around said core, said high voltage winding lying between said primary winding and said core, the high voltage transformer comprising a conductive coating means by which the electric field between said coil former and said core is reduced in order to avoid corona effects.

* * * * *